US012606762B2

(12) United States Patent
Zeitler et al.

(10) Patent No.: US 12,606,762 B2
(45) Date of Patent: Apr. 21, 2026

(54) FIRE PIT FUEL PACK

(71) Applicant: Lamplight Farms Incorporated, Menomonee Falls, WI (US)

(72) Inventors: Lucas Henry Zeitler, Wauwatosa, WI (US); Andrew Alan Harmeling, Milwaukee, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 0 days.

(21) Appl. No.: 16/799,099

(22) Filed: Feb. 24, 2020

(65) Prior Publication Data

US 2021/0002571 A1 Jan. 7, 2021

Related U.S. Application Data

(60) Provisional application No. 62/870,469, filed on Jul. 3, 2019.

(51) Int. Cl.

| | |
|---|---|
| ***C10L 11/04*** | (2006.01) |
| ***C10L 5/36*** | (2006.01) |
| ***C10L 5/44*** | (2006.01) |

(52) U.S. Cl.

CPC ..... *C10L 11/04* (2013.01); *C10L 5/363* (2013.01); *C10L 5/368* (2013.01); *C10L 5/442* (2013.01)

(58) Field of Classification Search

CPC ..... C10L 11/04; C10L 5/363; C10L 5/368; C10L 5/442; C10L 2200/0415; C10L 2230/06

See application file for complete search history.

(56) References Cited

U.S. PATENT DOCUMENTS

| | | | | |
|---|---|---|---|---|
| 2,206,362 | A * | 7/1940 | Mulcey | C10L 11/04 44/591 |
| 2,206,632 | A * | 7/1940 | Cornish | F02B 25/00 123/73 V |
| 5,626,636 | A * | 5/1997 | Carter | C10L 11/06 44/544 |
| 6,558,440 | B1 | 5/2003 | Price, Jr. | |
| 7,789,919 | B2 | 9/2010 | Helms, Jr. et al. | |
| 7,850,746 | B2 | 12/2010 | Weissman et al. | |
| 8,425,632 | B2 | 4/2013 | Perlman | |
| 9,187,705 | B2 | 11/2015 | Owens | |
| 2009/0098375 | A1 * | 4/2009 | Voisin | B32B 27/32 428/339 |
| 2012/0196232 | A1 | 8/2012 | Miller | |

(Continued)

FOREIGN PATENT DOCUMENTS

| | | | | |
|---|---|---|---|---|
| JP | 09286470 | A * | 11/1997 | B65D 81/3266 |
| WO | WO-03104362 | A1 * | 12/2003 | C10L 11/04 |

(Continued)

OTHER PUBLICATIONS

ULine "https://www.uline.com/BL_1951/Kraft-Paper-Rolls" Sep. 2008 (Year: 2008).*

*Primary Examiner* — Latosha Hines

(74) *Attorney, Agent, or Firm* — GableGotwals; David G. Woodral

(57) ABSTRACT

An outer wrapper has an outer layer and liner and arranged to form an interior volume. A quantity of fuel pellets is contained within the interior volume and faced by the liner. When ignited the outer wrapper burns away while igniting the quantity of fuel pellets.

9 Claims, 2 Drawing Sheets

(56) References Cited

U.S. PATENT DOCUMENTS

| | | | | |
|---|---|---|---|---|
| 2013/0232862 | A1 | 9/2013 | Wilgus et al. | |
| 2014/0238378 | A1 | 8/2014 | Scott | |
| 2015/0125574 | A1* | 5/2015 | Arent | B65D 75/20 426/106 |
| 2015/0225663 | A1 | 8/2015 | Gross | |
| 2015/0237876 | A1 | 8/2015 | Abram | |
| 2015/0374057 | A1 | 12/2015 | Tice | |
| 2017/0181578 | A1 | 6/2017 | Alanis Moreno | |
| 2017/0267940 | A1 | 9/2017 | Kowalski et al. | |
| 2018/0079981 | A1* | 3/2018 | D'Souza | C10L 11/04 |
| 2018/0100111 | A1 | 4/2018 | Fandrich et al. | |
| 2018/0148659 | A1* | 5/2018 | Mathews | C10L 11/06 |

FOREIGN PATENT DOCUMENTS

| | | | | |
|---|---|---|---|---|
| WO | WO-2008141752 | A1 * | 11/2008 | A47J 37/079 |
| WO | WO-2013030311 | A1 * | 3/2013 | C10L 5/143 |
| WO | WO-2013138703 | A1 * | 9/2013 | B64D 1/08 |
| WO | 2017176156 | A1 | 10/2017 | |

* cited by examiner

FIRE PIT FUEL PACK

CROSS-REFERENCE TO RELATED CASES

This application claims the benefit of U.S. provisional patent application Ser. No. 62/870,469, filed on Jul. 3, 2019, and incorporates such provisional application by reference into this disclosure as if fully set out at this point.

FIELD OF THE INVENTION

The present invention relates to fire pits in general, and more specifically, to a single use fuel pack for fire pits.

BACKGROUND OF THE INVENTION

Outdoor firepits provide a convenient way for consumers to enjoy the benefits of a campfire, bonfire, or cooking fire without building up a traditional fire lay. Regardless of what kind of fire setup is used, there remains a need to gather the fuel, stack it in a manner suitable for the fire, and ignite the fuel. Quality of fuel is an issue to be considered as green, wet, unseasoned wood, or wood that is otherwise unsuitable for burning, does not perform well. Further, the skill of the fire builder may play a substantial role in the performance of the fire; and even with good fuel, the fire may not perform well if fuel is stacked incorrectly. Even with adequate fuel prepared correctly, as the fire burns it may need to be adjusted or tended when burned. Finally, in order to achieve adequate burn quickly, some users find the need to use separate accelerants or fire starters.

What is needed is a system and method for addressing the above and related issues.

SUMMARY OF THE INVENTION

The invention of the present disclosure, in one aspect thereof, comprises a fuel pack for a solid fuel fire. The fuel pack includes a quantity of fuel pellets, and an outer wrapper at least partially containing the fuel pellets. The outer wrapper is ignitable to instigate combustion of the fuel pack such that substantially all of the quantity of fuel pellets and all of the outer wrapper burn in a controlled manner.

In some embodiments, the fuel pellets comprise a hardwood with an accelerant. The accelerant may comprise hydrotreated light distillate. The quantity of fuel pellets may have a bulk density between about 40-46 lbs/ft3, a moisture content of less than about 8.0%, and/or an ash content of less than about 1%.

The outer wrapper may comprise an outer paper layer backed by a polymer liner. In some cases the polymer liner comprises a coextruded polyethylene-Nylon-polyethylene material. The outer paper layer may comprise a 25-50 pound Kraft paper.

The invention of the present disclosure, in another aspect thereof, comprises a fuel pack. The fuel pack has an outer wrapper having an outer layer and liner and arranged to form an interior volume. The fuel pack also has a quantity of fuel pellets contained within the interior volume and faced by the liner, and an accelerant applied to the quantity of fuel pellets. The outer wrapper, by exposure to flame, exposes the quantity of fuel pellets for ignition.

In some embodiments, the fuel pellets comprise pelletized hardwood. The accelerant may comprise a hydrotreated light distillate. In some cases a ratio of accelerant to mass of pelletized hardwood is about 7%.

The outer layer may comprise a paper, such as a 25-pound Kraft paper. The liner may comprise a polymer that prevents escape of the accelerant from the interior volume. This may be a coextruded polyethylene-Nylon-polyethylene layer. It may have a thickness of about 2.5 mil. Some embodiments have a wick traversing the outer wrapper.

The invention of the present disclosure, in another aspect thereof, comprises a method of providing a solid fuel supply. The method incudes providing an outer wrapper having an outer paper layer backed by a polymer liner, forming an interior volume defined by the outer wrapper, and placing a quantity of wood fuel pellets into the interior volume. An accelerant is provided with the wood fuel pellets in the interior volume. The interior volume is closed to contain the wood fuel pellets and the accelerant. The method may include lighting the outer wrapper after closing the interior volume.

DETAILED DESCRIPTION OF THE PREFERRED EMBODIMENTS

Figure 1:
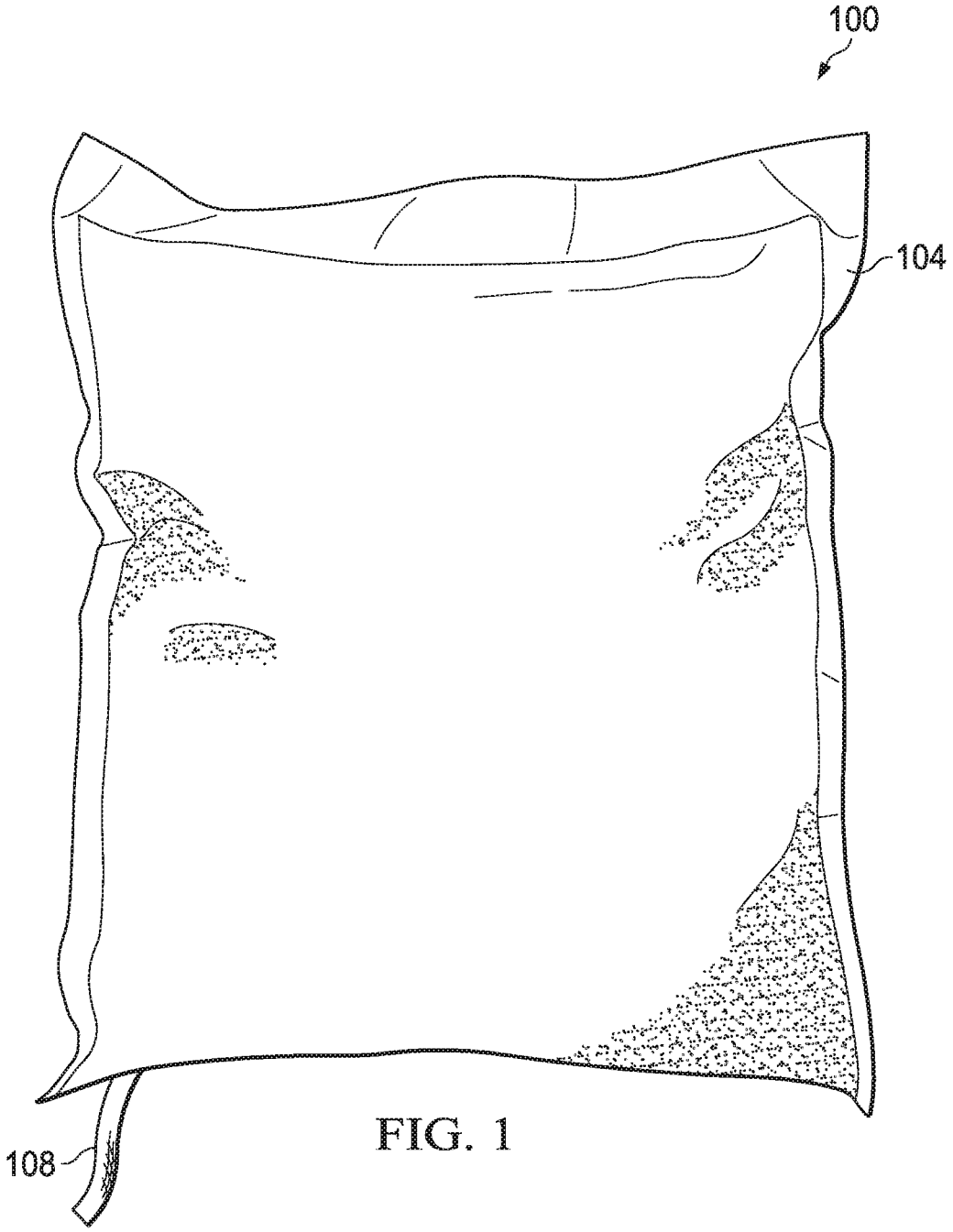
FIG. 1 is a plan view of a fuel pack according to aspects of the present disclosure.

Referring now to FIG. 1, a plan view of a fuel pack 100 according to aspects of the present disclosure is shown. The fuel pack of FIG. 1 provides a single use, easily ignited fuel source. The fuel pack 100 may be used in an outdoor fireplace or fire pit, or another place where solid fuel might be used to create a fire. The fuel pack 100 is easily ignited with a lighter or one (or a few) matches. Once ignited the fuel pack 100 quickly provides an adequately bright and low smoke fire. In some embodiments, "full flame" is achieved in under 5 minutes. The fuel pack 100 may be allowed to burn completely once ignited. The fuel pack 100 may burn for 30 minutes or more. However, additional fuel packs may be placed onto or into a fire having an already-ignited fuel pack to extend the burn time of the fire.

Figure 2:
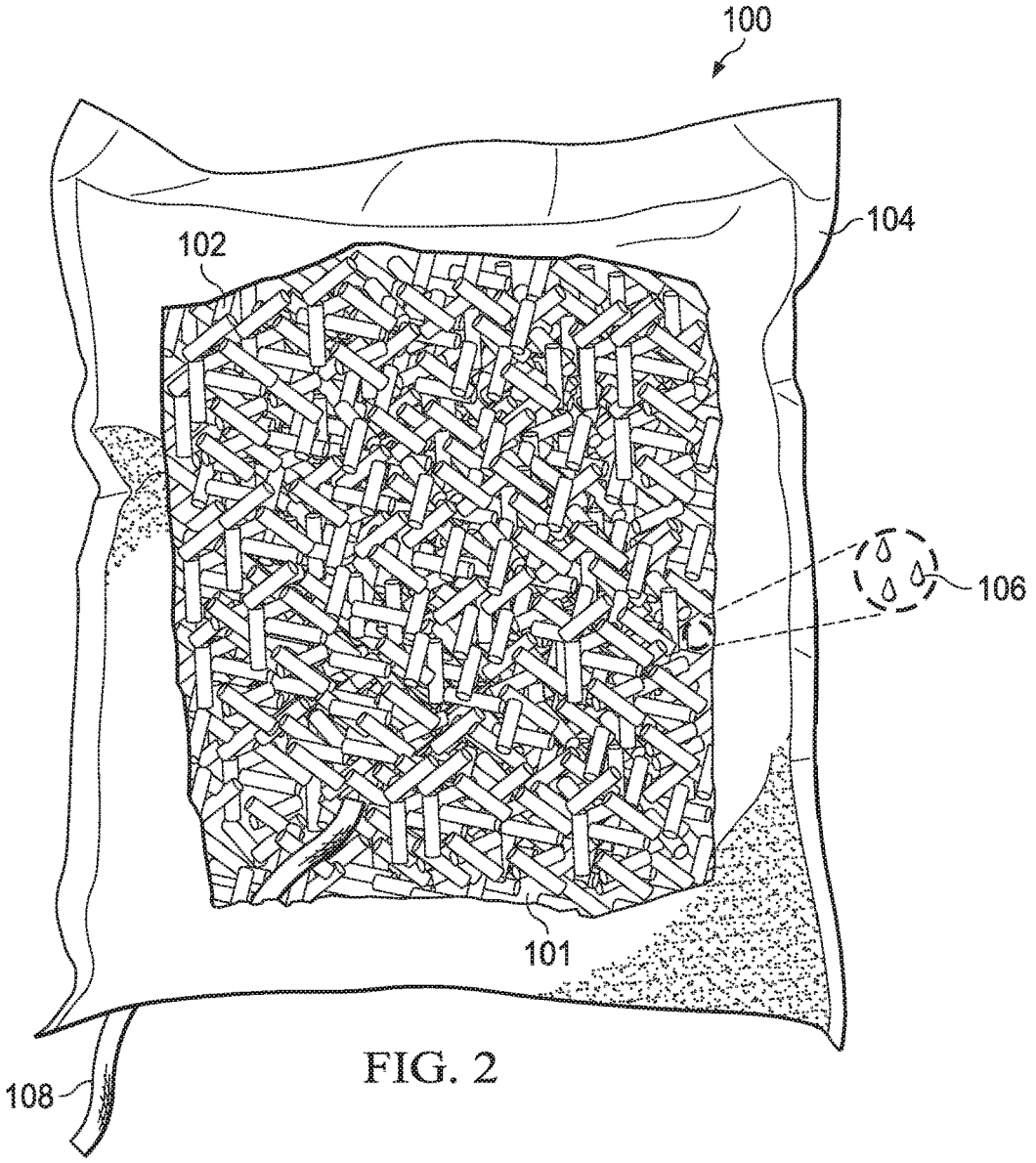
FIG. 2 is a cutaway plan view of a fuel pack according to aspects of the present disclosure.

Referring now also to FIG. 2, a cutaway plan view of the fuel pack 100 is shown. The fuel pack 100 comprises a quantity of fuel pellets 102 contained within an outer wrapper 104. The fuel pellets 102 may comprise wood, wood pulp, sawdust, or other wood-derived or plant-based products. In some embodiments, bio-mass products apart from wood may be utilized as an ingredient, or the main ingredient, in the pellets 102. In various embodiments, straw, hemp, herbs or other combustible fibers or materials may be used in place of, or included with, wood products for the pellets 102. In some embodiments, the fuel pellets 102 comprise a pelletized hardwood and may be configured to have a specific density, moisture content, and ash content. In one embodiment the bulk density is 40-46 lbs/ft3, the moisture content may range below 8%, and ash content may be below 1%. Where the pellets 102 are not hardwood-based, parameters may vary from these.

The physical dimensions of the fuel pellets 102 may bear on ignition, burn time, and other parameters. In some embodiments, the fuel pellets 102 are about 0.25 inches in diameter and from 0.5 to 1.25 inches in length. Wood-based pellets may fragment after manufacture or during transit. It has been found that embodiments of the present disclosure are not sensitive to pellet length.

In some outdoor solid-fuel burning applications, electric ignitors are utilized to reliably ignite wood-based pellets. However, various embodiments of the present disclosure utilize an accelerant 106. The quantity of accelerant 106 may vary and is not intended to be limited by the quantity or ratio to other components illustrated. Accelerant 106 may be included with the fuel pellets 102 as they are manufactured, or it may be applied by spraying, soaking, or other methods. The accelerant 106 may comprise hydrotreated light distillates (e.g., CAS 64742-47-8). The accelerant 106 may have a flashpoint of 142° F.-155° F. In other embodiments, the accelerant 106 may comprise hydro-treated medium or heavy distillates, modified or unmodified plant based oils, plant-based methyl esters, essential oils, or alcohols, petroleum based solvents, petroleum based oils, petroleum based fuels, waxes, plant fibers and/or combinations of these. In some embodiments, liquid accelerants with a flashpoint of less than 152° F. (but at least 142° F. or greater) may be used.

Further considering flash point of the accelerant 106 a lower bound or range may be specified that allows for manufacture without specialized explosion-resistant equipment (e.g., <142° F.). A top bound or range may be selected that ensures that one match can likely set off the "chain reaction" of ignition between pellets 102. It has been found that higher flash points (e.g., >155° F.) can prevent flame from jumping from pellet to pellet before dry wood fibers of wood-based fuel pellets 102 can self-sustain a flame. Thus, according to some embodiments, the flashpoint range of 142° F.-155° F. is selected.

In further embodiments, the accelerant 106 may comprise a solid material such as metal powders or specific plant fibers, and/or other solid components, possibly in combination with liquid accelerants. As flashpoint may be difficult or impossible to specify for such solids or combinations, flammability tests may be appropriate.

In embodiments utilizing hydrotreated light distillates (e.g., CAS 64742-47-8) for an accelerant 106 a ratio of about 7% distillate to wood mass may be appropriate. In one embodiment about 0.63 pounds of distillate may be combined or applied to about 9 pounds of wood pellets. A ratio of 8% or higher may lead to manufacturing challenges in dealing with the quantity of liquid relative to the wood mass. A ratio of below 6% may result in unsatisfactory experience for the user such as difficult ignition and/or slow burn. Where other accelerants are used, the ratio or volumes may vary.

In some embodiments, the approximate dimensions of the outer wrapper 104 are about 15 inches×10 inches×3 inches when filled. The volume may be about 450 cubic inches and it may be substantially filled with the fuel pellets 102. The outer wrapper 104 may be formed as an enveloping structure (with length and width as noted above, in some embodiments) defining an interior volume 101 into which the fuel pellets 102 are placed before the structure is closed off (e.g., by gluing, sewing, or the like). In one embodiment, approximately 9 pounds of fuel pellets 102 are used to provide approximately a 30-minute burn time. In other embodiments, the outer wrapper 104 is smaller, contains a smaller quantity of fuel pellets 102, and may burn for a shorter time. Such smaller versions of the fuel pack 100 may be used, for example, as a fire starter for a larger wood fire. It should also be appreciated that the general shape of the fuel pack 100 may differ from that shown and may include, but is not limited to, square, rectilinear, round, pillow, cylindrical, toroidal, or puck-shaped. Different shapes may provide for different burn characteristics.

It should also be appreciated that the interior volume 101 may comprise multiple volumes or compartments (not shown) within the outer wrapper 104. These may be formed as internal compartments separated by similar material as the outer wrapper 104 and/or the liner (e.g., 306 discussed below). The interior volume 101 might also be further compartmentalized by pinching and sewing or otherwise attaching opposite sides of the outer wrapper 104 together forming a quilt-like structure.

Figure 3:
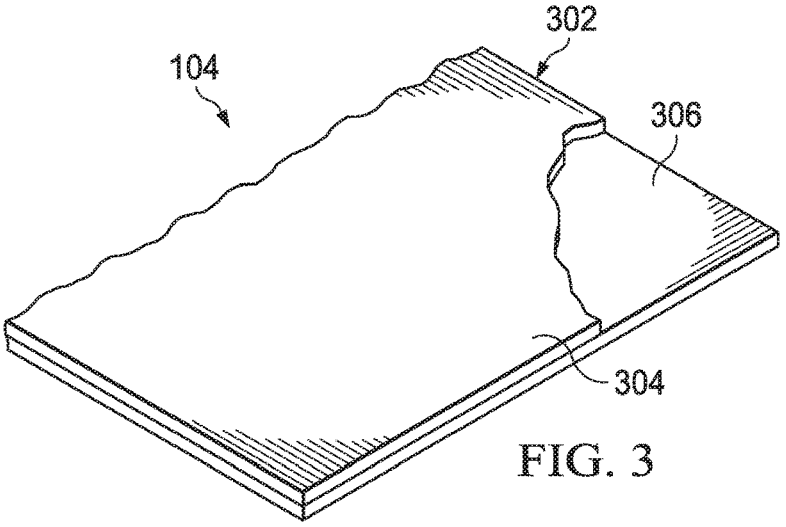
FIG. 3 is a close-up cutaway view of a fuel pack outer wrapper wall according to aspects of the present disclosure.

Referring now to FIG. 3 a close-up cutaway view of a fuel pack 100 outer wrapper 104 according to aspects of the present disclosure is shown. FIG. 3 illustrates an outer wrapper 104 having a wall 302 with a multi-layered construction. The outer wrapper wall 302 may comprise an outer layer 304 backed by a liner 306. In some embodiments, the outer layer 304 comprises a paper product such as 25-pound Kraft paper. In other embodiments, the weight of the paper may range up to 50-pounds. In other embodiments, other Kraft products, paper, wood pulp, burlap, or other fibrous materials may be employed.

The liner 306 may be arranged to face inward (to the fuel pellets 102). In some embodiments the liner 306 comprises a co-extruded material such as polyethylene-Nylon-polyethylene material with a thickness of about 2.5 mil. In other embodiments, the liner 306 may comprise other single or multi-layer heat sealable polymer films possibly including polyethylene, polypropylene, polyethylene terephthalate, Nylon, or other materials. In some embodiments, the liner 306 may be applied in one or more layers to the outer layer 304 to achieve a desired thickness.

One operation of the liner 306 is to contain and preserve the fuel pellets 102 and the accelerant 106 (e.g., when backed by the outer layer 304). The liner 306 should be chemically compatible with the accelerant 106 (e.g., not leak or substantially degrade in its presence) and robust enough not to become punctured or perforated by the weight of the fuel pellets 102 and/or rigors of transit and storage. Further, although the liner 306 may or may not promote combustion in and of itself, it should at least not inhibit lighting and combustion of the outer layer 304 needed to reliably ignite the fuel pellets 102.

Ash management may be a consideration in particular embodiments of the fuel pack 100. When the fuel pack 100 is ignited, the outer wrapper 104 should combust in a manner that allows airflow to quickly enter quantity of fuel pellets 102. If the ash content is too high or the paper ash does not fall apart, the airflow restriction eventually prevents full ignition. The outer wrapper 104 should ignite easily and pass flame on to the quantity of fuel pellets 102, but then fall, crumble, or be carried away so as not to impede air flow into the mass of pellets 102. Similarly, the pellets 102 should sustain a flame to ignite adjacent pellets but then fall away or otherwise allow airflow to the remaining unburnt pellets in the mass. Embodiments of the present disclosure have been shown to accomplish this kind of operation.

It should also be appreciated that embodiments of the present disclosure provide a product with a reliable but controlled burn. The embodiments are reliable in that by the use of one match or a lighter a user may light the fuel pack 100 without need for repeated re-lightings. In various embodiments, a fuel pack 100 may be lit by being placed onto another burning fuel pack or other fire source. The embodiments of various fuel packs 100 provide a controlled burn in that combustion begins and produces a visible flame with acceptably low smoke in short order (e.g., under 5 minutes) without rapidly burning up or unexpectedly extinguishing. Embodiments with 9 pounds of fuel pellets 102 may be expected to burn for up to about 30 minutes, but larger or smaller fuel packs 100 produce longer or shorter burn times. Moreover, various embodiments of the fuel pack 100 are shelf-stable for extended periods of time.

In other embodiments, the wrapper 104 may comprise materials that are more resistant to flammability than is likely to be convenient for lighting with a match or lighter. In some cases, sustained contact with flame may be required to ignite the outer layer 304 and/or liner 306, or it may be that the pellets 102 themselves require at least some degree of ignition before the wrapper 104 can be suitably ignited or consumed such that acceptable ash control is achieved. A wick 108 may be provided in these or other embodiments. The wick 108 may be accessible outside the fuel pack 100, or otherwise available on or near the surface of the wrapper 104. The wick 108 may be easily ignitable by match or lighter and then, in turn, ignite the wrapper 104 and/or pellets 102. In such case, the wick 108 may actually come near or into contact with the pellets 102 (such as by passing through the wrapper 102 and into the interior volume 101 with the pellets 102). The wick 108 may be a cotton wick or comprise other materials and it may or may not be treated to enhance burn time and/or ignition.

In further embodiments, the fuel pack 100 may also be ignited by opening or tearing away part of the wrapper 104 (e.g., a tab or the like). The loose wrapper 104 may then be more easily ignited. In some embodiments, the wick 108 may be attached to the wrapper 104 such that pulling or tearing the wick 108 or wrapper near the wick 108 will further expose the wick 108 and/or wrapper 104 for ease of ignition. In some embodiments, tearing or pulling of the wrapper 104 and/or wick 108 exposes pellets 102 such that they may be directly ignited.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fuel pack for a solid fuel fire comprising:

a quantity of fuel pellets of uniform diameter and having an accelerant; and an outer wrapper at least partially containing the fuel pellets;

wherein the outer wrapper comprises an outer paper layer backed by a polymer liner containing the quantity of fuel pellets within an interior thereof adjacent to and contacting the fuel pellets, the interior containing no other combustible material beyond the quantity of fuel pellets;

wherein the outer wrapper is ignitable to instigate combustion of the fuel pack such that substantially all of the quantity of fuel pellets and all of the outer wrapper burn in a controlled manner;

wherein the polymer liner comprises a coextruded material having a Nylon layer interposing first and second polyethylene layers with the Nylon layer being adjacent to both the first and second polyethylene layers; and wherein the outer paper layer forms an outside surface of the outer wrapper;

wherein the outer paper layer comprises a Kraft paper having a weight from 25 to 50 pounds.

2. The fuel pack of claim 1, wherein the accelerant comprises a hydrotreated light distillate.

3. The fuel pack of claim 2, wherein the quantity of fuel pellets has a bulk density between about 40-46 lbs/ft3.

4. The fuel pack of claim 3, wherein the quantity of fuel pellets has a moisture content of less than about 8.0%.

5. The fuel pack of claim 4, wherein the quantity of fuel pellets has an ash content of less than about 1%.

6. A fuel pack consisting of:

an outer wrapper consisting of an outer paper layer backed by a polymer liner and arranged to form an interior volume bounded by the polymer liner;

a quantity of fuel pellets contained within the interior volume at least some of which are in contact with the polymer liner; and an accelerant consisting of a hydrotreated light distillate applied to the quantity of fuel pellets;

wherein the outer wrapper, by exposure to flame, exposes the quantity of fuel pellets for ignition; and wherein the liner consists of a coextruded arrangement with a Nylon layer interposing first and second polyethylene layers with the Nylon layer being adjacent to both the first and second polyethylene layers;

wherein the quantity of fuel pellets consist of a pelletized hardwood having a pellet diameter of a uniform size.

7. The fuel pack of claim 6, wherein a ratio of accelerant to mass of pelletized hardwood is about 7%.

8. The fuel pack of claim 6, wherein the outer paper layer comprises a 25-pound Kraft paper.

9. The fuel pack of claim 6, wherein the liner has a thickness of about 2.5 mil.

* * * * *